US005360537A

United States Patent [19]

Strumskis

[11] Patent Number: 5,360,537

[45] Date of Patent: Nov. 1, 1994

[54] APPARATUS AND METHOD FOR RETORTING OIL SHALE AND LIKE MATERIALS

[75] Inventor: Louis Strumskis, New Port Richey, Fla.

[73] Assignee: Georgia Oil & Gas Co., Inc., Richey, Fla.

[21] Appl. No.: 14,103

[22] Filed: Feb. 3, 1993

[51] Int. Cl.[5] ..... C10G 1/00; C10B 57/04; C10B 51/00

[52] U.S. Cl. ..... 208/400; 208/403; 208/428; 208/435; 201/20; 201/25; 201/36; 201/37; 201/38

[58] Field of Search ..... 208/400, 403, 428, 435; 201/20, 25, 36, 37, 38

[56] References Cited

U.S. PATENT DOCUMENTS

| | | | |
|---|---|---|---|
| 1,280,178 | 10/1918 | Day | 201/20 |
| 1,374,887 | 4/1921 | Sawtelle | 201/30 |
| 2,796,390 | 6/1957 | Elliott | 201/36 |
| 4,325,787 | 4/1982 | Strumskis | 201/34 |
| 4,396,487 | 8/1983 | Strumskis | 201/25 |

*Primary Examiner*—Paul Lieberman
*Assistant Examiner*—Patricia L. Hailey
*Attorney, Agent, or Firm*—Dominik, Stein, Saccocio, Reese, Colitz & VanDerWall

[57] ABSTRACT

A continuously operable combustion-type retort apparatus includes an insulated retort. A preheater is preferably associated with the retort for preheating incoming material, and means are preferably provided for injecting acetic acid and steam into the incoming material. Heat is supplied from a combustion zone arranged near the bottom of the retort, wherein means are provided for combusting spent shale to provide the heat necessary for retorting. Means for injecting acetic acid and water are arranged above the combustion zone for preventing the combustion from spreading into the material being retorted. The invention also comprises a method of retorting to produce a very high quality oil from shale and having a 7:1 ratio of carbon to hydrogen, along with the production of valuable nitrogen related chemicals, activated lignin and cement.

13 Claims, 2 Drawing Sheets

APPARATUS AND METHOD FOR RETORTING OIL SHALE AND LIKE MATERIALS

FIELD OF THE INVENTION

This invention relates to an apparatus and method for ex situ processing of oil shale and other oil-yielding solid particulate materials such as lignocellulosic materials to recover petroleum-like products therefrom.

BACKGROUND OF THE INVENTION

It has long been attempted to economically exploit oil shale as a source of shale oil. Basically, at temperatures above 900° F., a disproportionation of carbon and hydrogen structures in kerogen occurs. The solid high molecular weight kerogen is broken down and converted into a distillable hydrocarbonaceous liquid oil fraction with a lower carbon to hydrogen ratio and other fractions. The volatilized oily distillate can be recovered as a useful distillate.

In a conventional retort, the yield of the oil is in the range of about 60–70% of the organic matter in the raw shale. An additional 7 to 10% is converted into light gases and about 20 to 25% into a carbon rich residue retained in the organic material called char. As described in Kimberlin et al., U.S. Pat. No. 2,966,450, shale oil is characterized by a high nitrogen content, low carbon to hydrogen ratio, and high sulfur content.

U.S. Pat. No. 2,694,037 (Johnson et al.) describes a method and apparatus for the production of shale oil from oil shale. Oil-bearing material, particularly oil shale, is crushed, preheated by contact with the gaseous product from a downstream cracking reactor, and then passed to a retorting zone wherein the shale bed is passed downwardly countercurrently to the rising stream of hot gases so as to separate the oil from the oil-bearing material. Combustion occurs in the lower section of the retort, sustained by oxygen enriched air, preferably approximately pure oxygen. Close to the zone of combustion and directly beneath it is located means for introducing and distributing water used to cool hot spent shale coming from the zone of combustion and thereby supply steam required for the process and control of the volume percentage of oxygen in the zone of combustion. The steam is superheated as it passes upwardly through the combustion zone and acts with the combustion gases to supply heat necessary to drive the oil from the oil shale. Vaporized shale oil is quenched and cooled in a quench tower and fractionated. Johnson et al further disclose a helical screw-type conveyor for removing fresh shale to a mixer or other treating apparatus.

U.S. Pat. No. 4,058,205 (Reed) discloses the production of crude shale oil by a process wherein crushed oil shale is mixed with small quantities of coal, preheated, and retorted in a horizontal chamber by the indirect heat obtained when the residual char and coal mixture is burned in a furnace. Reed indicates that in situ retorting, where shale is burned in place and the heat produced decomposes the surrounding shale, has been largely unsuccessful because of the impermeability of the shale which prevents movement of the gases including both the air required for combustion and the product vapors. Also known, as indicated in Reed, is direct combustion retorting where crushed shale is heated by combustion occurring in the retort by burning injected fuels and/or residual carbon remaining in the retorted shale. This is done in a vertical vessel where fresh shale is fed into the top of the vessel and spent shale is removed from the bottom. Air for combustion is forced into the bottom where combustion occurs. The hot gasses pass up through the shale causing the kerogen to decompose. The product is removed as a vapor out of the top and condensed. The design is described as having the advantage of good heat efficiency, but the disadvantage of dilution of the retort gases with combustion gases.

Considering now the various apparatus that have been devised for the extraction of oil from oil shale, U.S. Pat. Nos. 52,283 and 52,284 (Gengembre) disclose an apparatus for solvent extraction followed by distillation. U.S. Pat. No. 2,966,450 (Kimberlin et al) also mentions the use of acetic acid in conjunction with solvent extraction apparatus, but indicates that acetic acid is unsuitable for this purpose, either because of ineffectiveness or because of lack of selectivity. The Gengembre patents and U.S. Pat. No. 2,073,367 (Fisher) disclose a rotating shaft with stirring fingers that agitate material inside a cylindrical vessel. Fisher relates to conversion of mixtures of hydrocarbon oil and solid or semi-solid bituminous material, such as coal, peat, lignite, oil shale and the like, for the production of gas and liquid products.

U.S. Pat. No. 4,260,471 (Miller) extracts sulfides from coal with acetic acid in the production of synthetic fuel. Sulfur, bonded in pyritic and organic compounds, is converted into a sulfide compound which may be extracted or leached from the coal or carbonaceous material with an acid. Extraction of the sulfides with an acidic compound results in the dissolution of the sulfide compounds and the release of sulfur as hydrogen sulfide. The hydrogen sulfide is then sent to a hydrogen sulfide absorbing solution, such as an amine solution, where hydrogen sulfide is recovered. In a preferred mode of the invention disclosed in U.S. Pat. No. 4,260,471 (Miller), crushed coal, water and acid are introduced into a mixing vessel to prepare a slurry. A wide variety of acids may be used, including hydrochloric, nitric and even acetic acid. The slurry is transferred to a heating zone and then a pressurized reaction zone where the pressure is increased to 100 to 4,000 p.s.i. for 0.5 to 30 hours, for removal of pyritic sulfur, although organic sulfur remains. There is, however, no mention of distillation.

U.S. Pat. No. 2,701,787 (Hemminger et al.) discloses an apparatus for distilling oil shale wherein the heat for distillation is supplied by carrying out the distillation in indirect heat exchange with a fluidized mass of spent shale highly heated by combustion.

U.S. Pat. Nos. 4,104,537 (McQuitty) and 4,107,029 (Lorenz) each disclose a scraper at the bottom of a cylindrical vessel adapted to treat aqueous suspension or slurries of tar sands or the like. U.S. Pat. Nos. 4,110,194 (Peterson et al.) and 4,189,376 (Mitchell) both disclose solvent extraction processes involving helical screw type conveyors for removing used particulate solids from the bottom of a treatment vessel. Peterson also discloses stirring fingers. Mitchell discloses means for injecting steam and solvent into different zones of the extraction vessel.

There remains a need for a more efficient, complete and economical extraction process in which a higher proportion of known valuable products are recovered. There also remains a need for a process which enables the recovery of new products, making the oil shale retort operation more economically sustainable.

SUMMARY OF THE INVENTION

It is an object of the instant invention to provide a continuous retort system wherein a stream of solid particulate oil bearing or oil producing raw material can be introduced into the top of a retort or silo reaction chamber where it is heated to successively higher temperatures until petroleum-like oil products separate therefrom by volatilization into a gaseous mixture.

It is a further object of the invention to provide a continuously operable retort apparatus for obtaining petroleum-like products, cement and valuable nitrogen-related chemical products from shale or other oil-producing carbonaceous solids.

It is a further object in the system to provide improved insulation means for better control of the temperatures in the retort near the walls, which insulation means is further capable of acting as a passage for air, which air can serve to cool the outgoing cement and as a transfer medium to transfer such heat to the cooler raw materials entering the retort.

It is a further object of the invention to provide means to combust retorted shale at the bottom of the silo as well as means to attenuate or control the combustion.

Another object of the invention resides in providing a means for automatically stopping the feed of shale or other oil bearing material into the retort to automatically maintain the appropriate amount of material in the silo.

Still another object of this invention lies in the provision of a continuous running retort apparatus which includes means for enhancing the gravity flow of material downwardly through and out of the retort.

Yet still another object of the instant invention is to provide an environmentally acceptable system for the production of oil products form oil bearing and other oil yielding organic solid materials.

A still further object residues in the provision of a continuous-running trouble-free retort silo system in which the material to be processed is heated gradually so that the oil products are discharged from the retort as they are formed, and are not decomposed by excessive heating after they are formed. A further object of the invention is to provide a method of separating petroleum-like products from comminuted oil shale or other oil-yielding solids particulate materials at lower temperatures, making possible a less destructive retort with less total B.T.U. requirement than heretofore possible.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DISCUSSION OF THE INVENTION

Figure 1:
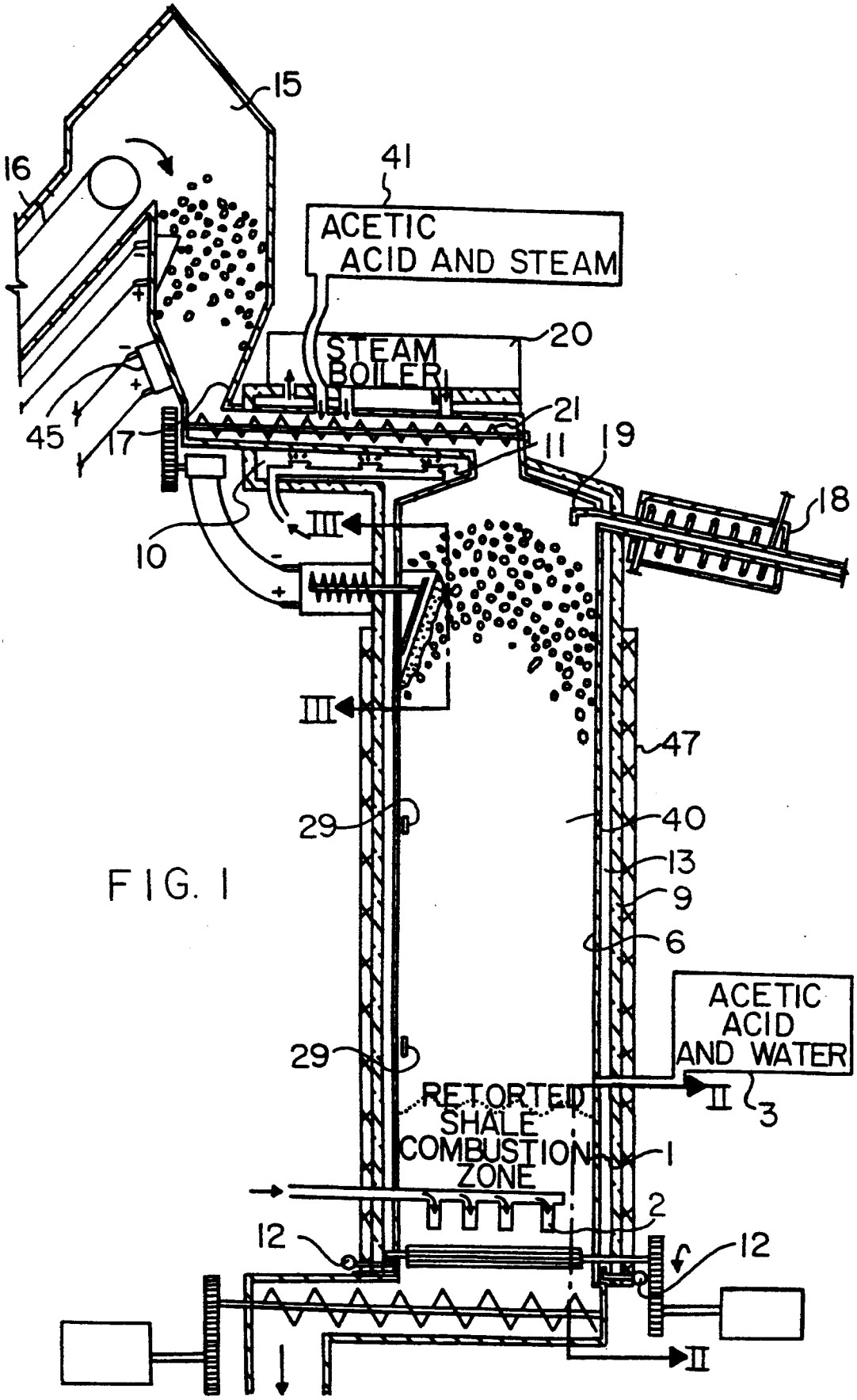
FIG. 1 is a generally schematic illustration of the apparatus of the system, with parts thereof indicated in vertical section, of the retort and discharge apparatus associated therewith.

The above objects have been achieved as a result of the discovery that acetic acid, when provided at high temperature in the presence of very hot steam and combustion gases, is able to mediate the denitrification or breakup of nitrogen-containing molecules, such as the proteinous kerogen in the shale rock. The nitrogenous compounds are lowered in molecular weight and more easily distilled off. The acetic acid facilitates the release of oil and other valuable nitrogen containing organic compounds such as amines, anilines and xylidines. The remaining crude, which is low nitrogen crude, can then be sent to any refinery for processing. This is an advantage of the present invention, since conventional crude oil from shale must be sent to a special refinery.

It has been reported that various dilute acids, such as hydrochloric or sulfuric acid, may help overcome the adsorptive force by which particles of oil cling to the surface in the pores of the shale. It has been hypothesized that the vapor from the distilling of retort, which includes acetic acid along with phenols, pyridines and other acids, when deposited on cold shale as retort gases pass by cold shale in a countercurrent flow process, give assistance to the breaking of the absorptive bond between the oil and the shale, thus lowering the amount of acid which would otherwise be added for this purpose. See U.S. Pat. No. 1,260,178 (Day).

In the present invention, however, the acetic acid plays a far more significant role. The acetic acid, injected in the presence of high heat, steam and combustion gases in the zone below the retort zone and immediately above the combustion zone, acts as a molecular catalyst, causing a shift reaction to occur without the necessity of 300 p.s.i. pressures normally required for such a reaction to occur. That is, as a result of the injection of acetic acid and water, which flashes to steam, in accordance with the present invention, large quantities of carbon monoxide are obtained at the combustion zone in accordance with the known formula $C+H20=CO+H2$ (see U.S. Pat. Nos. 1,481,399 (Webert) and 4,298,453 (Schoennagel et al). Instant steam above the 900° F. range is produced when the water spurts into the combustion fire. This conversion of water into instant steam produces only 3 to 4 atmospheres of localized and quickly-dissipating pressures (45 to 60 p.s.i.). The shift reaction which follows the combining of CO, steam and acetic acid produces large quantities of free carbon and hydrogen, and the end result of the distillation is a novel liquid organic product which tested at 185% of Fischer assay. The crude oil has a 11.4% hydrogen content and a 7:1 weight ratio of carbon to hydrogen, which is equal to light Saudi crude.

The precise method of action of acetic acid has not yet been determined, but it is clear that the beneficial effects of acetic acid are not due merely to a lowering of the pH. Strong mineral acids and higher fatty acids, when used in place of acetic acid, do not produce the beneficial results achieved with acetic acid.

It is known that acetic acid is produced as a by-product in the destructive distillation of wood in the case that the present invention is applied to the distillation of wood. Thus, a retort gas stream passing over a bed of solids may carry acetic acid separately from and in addition to the acetic acid injected in accordance with the present invention.

The amount of acetic acid to be used in the process of the present invention is in the amount of about 30 to 90 pounds, preferably about 60 pounds of acetic acid (calculated as pure acetic acid) per ton of shale or other ligneous materials.

In the case of preheating the solid material to be retorted, the preheating is preferably accompanied by pretreatment with acetic acid in the manner described in U.S. Pat. Nos. 4,396,487 and 4,235,787, with the weight ratio of the amount of acetic acid supplied to the preheating step to the amount supplied immediately above the combustion zone being about 0–30:60–30, preferably 5–30:55–30, and most preferably 10:50.

Prior art systems for the extraction of oil from oil bearing solids have not used acetic acid in the process of operation thereof in the manner of the present invention. It is particularly surprising that the addition of the steam and acetic acid to the solids in the very high temperature environment immediately above the combustion zone results in a breaking down of kerogen or other organic materials or promotes desorption and volatilization of organic materials, resulting in the liberation or formation of a novel and unique mixture of gases which stream upwardly through the bed of solids and act in a synergistic manner to desorb and entrain organic materials still stubbornly remaining in the solid materials.

The heating of solids in a retort by means of a controlled combustion zone directly in the interior of the retort and arranged at the bottom of the retort, and the recovery of retorted gases produced thereby, may be carried out in a manner similar to that disclosed in U.S. Pat. No. 4,075,083 (Putman), the disclosure of which is incorporated herein by reference.

The economic object of this invention is further achieved by the provision of acetic acid and very hot steam at the preheating zone. Indirect heat is provided by the preheating zone gas burners. Steam condenses initially on the cold shale, and the wet shale is increased in heat conductivity. The very hot steam provides a further supply of fast heat to the cold incoming shale. The acetic acid here initiates the softening of the proteinous kerogen in the shale to permit retort to take place at 100 degrees lower temperatures than possible by conventional means. Hence, more of the valuable volatile products are able to retort and not burn up due to the high heat requirements in conventional methods before volatilization is initiated, and more economically valuable products can be recovered.

In correlation with the foregoing object, it is desired to introduce a shale material which is heated above 150° F. in to the main tank to prevent any condensation of the upward flowing retorted gases before these exit at the top of the main tank, which condensation would take place if, e.g., cold Colorado shale is introduced into the retort tank. Hence, one can increase the efficiency and rate flow in this continuously operable retort apparatus.

The system of the present invention, like that disclosed in my earlier U.S. Pat. No. 4,327,787, envisions a continuously operative system wherein crushed coal, oil shale, oil sands, wood (see U.S. Pat. Nos. 1,259,277 (Palmer), 1,271,071 (Palmer) and 1,374,887 (Sawtelle), peat, milkweed, pine tree trimmings, or the like are dumped from a dump truck into a receiving hopper for conveyance to a storage bin, from which bin it is then fed by an auger-type screw conveyor into the retort or silo where the separation process is effected. The apparatus incorporates inlets for acetic acid for use in the extraction process at the initial mixing and conveying stage as well as at least one additional downstream location along the lower portion of a vertically oriented retort silo to provide for this introduction of additional acetic acid at an additional predetermined zone in the interior of the retort. Separation and continuous or periodic removal of the end products of the process together with the functioning of closed circuit systems for heat control, efficient use of hot gas, and use of steam both for heating and the admixing of acetic acid, facilitate the continuous operational nature of the apparatus.

Unlike the apparatus of U.S. Pat. No. 4,325,787, the system of the instant invention also envisions means associated with additional acetic acid injection at the bottom of the retort where combustion is occurring while providing water with the acetic acid to attenuate or control the degree of combustion of the retorted shale.

In a preferred embodiment of the present invention, the apparatus of the present invention comprises retort means having hollow insulation means for insulating the retort means. Feed means are associated with the retort means for introducing a continuous stream of particulate solid raw material into the upper portions of the retort, with a preheating arrangement associated therewith for indirectly preheating the particulate solid material before it enters the retort. A combustion zone is arranged at the bottom of the retort with combustion means associated therewith to combust the retorted shale, entering the zone after being processed in the main body of the retort, under predetermined controlled conditions. Gaseous products discharge means are also associated with the retort for discharging gaseous products therefrom, with a condensing arrangement associated therewith for condensing volatilized liquids from the discharged gaseous products. To remove the combusted spent shale, a cement discharge mechanism is provided below the spent shale combustion zone. Activated lignin may also be produced from lignocellulosic materials such as wood, milkweed or peat in the manner set forth in U.S. Pat. No. 4,396,487 by modifying the process demonstrated in Example II thereof in accordance with the present invention.

In correlation with the foregoing, it is a further advantage of the present invention that, upon the inducement of the shift reaction, a marked increase in noncondensible gases such as butane occurs. Some of this noncondensing gas can be used as a fuel in the preheating zone and the rest of the gas can be recovered. Butane can be converted into acetic acid, for example, using the procedure set forth in English Patent No. 10,687 (Calvert), for an inhouse production of all the acetic acid required at the retort site.

In another aspect of the invention, the retorted shale combustion zone provides a direct source of heat to an inner wall of the retort making up part of the insulation means, so that air passing through the insulation means can act as a carrier of the heat to provide a source of indirect heat for the material at the periphery in the retort. Thus, effectively a source of indirect heat is provided by this arrangement.

In a further embodiment, the solids discharge means includes not having the bottom portion of the retort means of a cone-shaped configuration, which normally restricts the gravitational flow of combusted spent shale. Instead, an auger screw and breaking means run the full width of the retort means bottom to break up any clusters of spent combusted shale, and to remove it from the retort silo.

Still further, control means can be provided for automatically stopping the feed of particulate solid material into the retort silo when the level of material in the silo reaches a predetermined value. Specifically, the control means will generally comprise a spring loaded assembly responding to pressure from the material stock so that when the pressure exceeds a predetermined value, the feed is stopped, and as material is removed from the silo, thereby reducing pressure, the feed is started again.

In a more specific embodiment, the combustion means includes at least eight pressurized cold air inlets provided in the combustion zone at the lower end thereof, and an electric coil surrounds said zone so that upon activating the electric coil, with the cold air feed, the retorted shale will start to combust. Acetic acid and steam injection means are provided to attenuate the degree of combustion and to further enhance separation of any remaining oil products from the retorted shale. The distribution of the cold air inlets is such as to facilitate heating the incoming air, and also serves to cool the combusted shale being removed from the retort means.

Referring now to the drawings, and more particularly to FIG. 1 thereof, a preferred embodiment of the overall system of the invention is shown therein, the principal unit of which is a vertically disposed retort silo assembly generally indicated at 40. It should be noted at this time that the additional means associated with the main retort assembly are not shown on either side, as indicated by the breaking off lines at 16 and after 18, and the means connected are generally disposed in U.S. Pat. No. 4,325,787, whose disclosure has been incorporated by reference herein.

The apparatus associated therewith includes a receiver hopper (not shown) of any suitable nature for reception of the starting particulate raw material which may be unloaded as for example, from a dump truck. The crushed oil shale or the like is conveyed from the hopper by an endless/belt type conveyor of a conventional nature which may be of any suitable type such as a bucket or plate flight character, as well known in the art. The discharge end of the conveyor is in proximity to an endless belt type elevator which provides communication generally from the hopper to a discharge end indicated at 16.

The elevator discharges raw material and dumps into a bin 15. The lowermost inclined surfaces of bin 15 discharges at the bottom 17 thereof into an auger screw type feed conveyor 21. The conveyor 21 provides communication between the discharge opening of the bin 15 and the interior of the retort 40.

The material is fed into the retort 40 in sufficient mass quantities to utilize the heat of retorted gaseous products. In the present invention, as in U.S. Pat. No. 4,325,787, the retorted gaseous products exit into condenser 18, which is kept open from material blocking it by means of a shield 19. In condenser 18, volatilized liquids are condensed and separated from gaseous products discharged from the retort. However, these gaseous products are passed through outlets 11 to preheating chamber 10 associated with auger screw feed conveyor 21 wherein the noncondensible gases are burned to preheat the incoming material. An electromagnetic or pneumatic vibrator 45 is provided at the bin to keep incoming shale from hanging and to prevent the steam and acetic acid from escaping. Preferably the vibrator is placed in the bin adjacent the side of auger 21. If necessary, the auger 21 can be oriented at an angle.

The pot method of recovery is utilized with a very small condenser 18 for all gasified products. With the pot method, four units are used for difficult to condense products obtained with the acetic acid approach. The pot method of recovery is a standard process with a whirlwind unit as the first unit and an electrostatic unit as the last unit with intermediate units therebetween. Other methods of recovery are known, as seen for example in U.S. Pat. Nos. 2,710,828 and 2,832,725 (Scott).

Also associated with the feed auger screw conveyor 21 and the preheat chamber 10 are a first acetic acid dispensing tank 41 and a first steam boiler 20 which operate and are arranged much in the same manner of the acetic acid supply and steam boiler disclosed in U.S. Pat. No. 4,325,787. Heat from chamber 10 serves to heat water in the boiler 20 to produce the steam supply.

The structure of the retort silo 40 comprises an inner tank wall 6, typically made of a material capable of withstanding high temperatures, e.g., 1000° F., in the presence of acetic acid. An outer tank wall 9 is spaced from the inner tank wall 6 to define a space 13 therebetween in communication with preheat chamber 10. Furthermore, an air flow regulating valve 12 is arranged near the bottom of the outer tank wall 9 to admit and control air flow into space 13 so as to provide a natural updraft of outside air, and to furnish the necessary oxygen to support combustion in preheat chamber 10. To prevent heat losses, the outer tank wall 9 is well insulated 47 thereby conducting the heat into the preheat chamber 10.

The materials from which the inner and outer tank walls 6 and 9 are made are conventional in nature, and equivalents are well known to those skilled in the art and can be easily substituted therefor. However, in one embodiment the inner tank wall 6 will be of suitable structural steel clad on the inside on stainless steel Ch. 3 (Carpenter No. 3) to withstand temperatures in excess of 1000° F. in the presence of acetic acid. The outer tank wall 9 can also be of steel and is well insulated, sufficient to keep the winter cold out of heat recovery area 13 and retort wall 6, as previously described.

At the bottom of the retort silo 40 is a retorted shale combustion zone 1 which is adapted for combusting retorted shale therein to provide the heat necessary for operating the retort and for removing any remaining tailings in the retorted shale. Furthermore, the hot gases resulting from combustion of retorted shale in this zone move upwardly to heat the shale in the retort, and facilitate its fluid movement downward through the retort silo 40 without requiring the shaft and stirring mechanism of U.S. Pat. No. 4,235,787 or any other like mechanical device.

Figure 2:
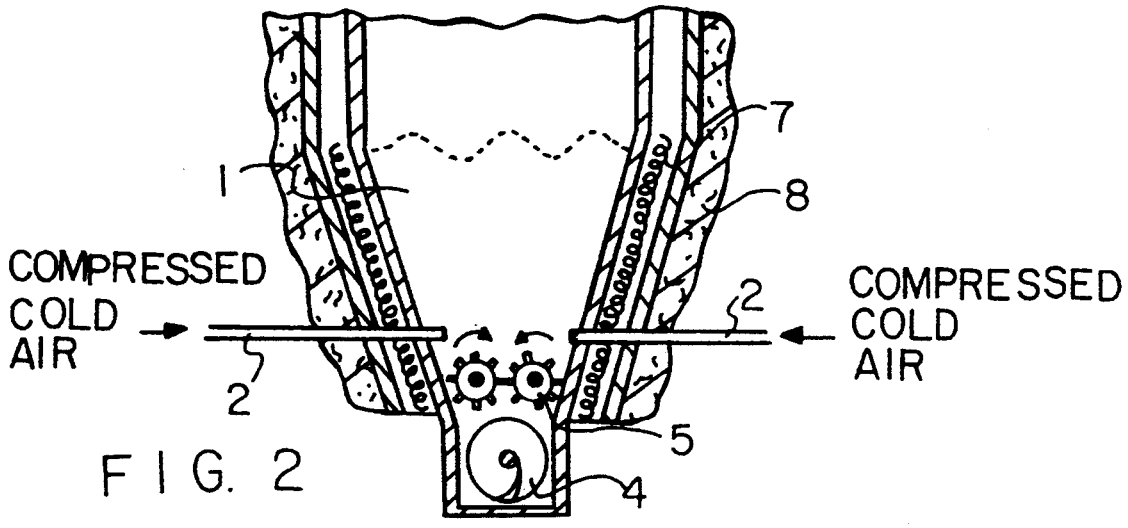
FIG. 2 is a partial sectional view taken from the side along line II—II of FIG. 1 and showing details of the solids discharge mechanism and the lower end of the combustion zone.

In a preferred embodiment as seen in FIG. 2, the retorted shale combustion zone 1 includes a heating arrangement, typically surrounding the walls of the retorted shale zone 1 to provide the heat necessary to initiate combustion of the retorted shale. The initial preferred heating arrangement will be made up of electric coils 7 powered by a conventional power supply, and surrounded by very heavy insulation 8. With such an arrangement, temperatures of 900° to 1000° F. can be attained. Electricity is turned off once combustion begins place.

Preferably, combustion is sustained by the provision of no less than eight pressurized or compressed cold (ambient) air inlets 2 arranged at the bottom of the spent shale zone 1 to force cold air into the combustion zone. Thus, the retorted shale with only carbon and calcites remaining will begin to combust upon input of pressurized air through inlets 2. To control or attenuate the combustion, there is provided a second cold (ambient) water and acetic acid source 3 which is injected immediately above the burning shale to prevent the fire from burning into the shale which is yet to be retorted. This cold water and acetic acid source also produces additional carbon monoxide for the shift reaction. In the arrangement, it is preferred that the inlets 2 be evenly distributed throughout the lower end of the spent shale combustion chamber so that the incoming air is heated as it travels upward, and also serves to cool the burnt, light gray spent shale being removed from the retort 40. This material can then be used for a number of applications such as cement suitable for highways, sidewalks, cement floors and cement blocks in home construction, a filler for mixed areas from whence shale has been extracted, etc.

A cold free-air (not compressed) intake 12 is located at the very bottom of the chamber as between the double silo to further cool the cement and to provide warmed air to the preheat area and steam boiler.

As a result of the contact between the combustion zone 1 walls and the inner tank wall 6, heat is conducted indirectly by means of the inner tank wall 6 to the material at the periphery in the retort silo 40. Likewise, this indirect conduction of heat serves to heat up the air admitted via valve 12 thus facilitating combustion in preheating chamber 10 and greatly enhancing the effective insulation against heat loss from the retort silo 40.

The control or attenuation of the fire at the top of the retorted shale combustion zone 1 is achieved by providing an acetic acid and water source adapted to feed the acetic acid and water in spurts over the top of the zone 1 to cover as much of the fire as possible to prevent it from spreading into the material being retorted and to maintain temperatures below 1050° F. in the combustion zone to prevent dolomite decomposition. Sensors 29 are provided, conventional in nature, to monitor the temperature throughout different levels of the retort, of readjusting combustion in zone 1 accordingly.

In this process, there is evolved an excess of non-condensing gas, much of it butane, some of which can be used in the preheat area 10. Since acetic acid is today made from butane, any remaining butane can be converted into acetic acid.

To enhance the process, the entire chamber is surrounded by a layer of insulation 47.

As clearly shown in FIG. 2, removal of burnt shale is facilitated by means of a discharge auger screw conveyor 4 at the outlet at the bottom of the spent shale zone 1. In order to not impede removal by gravity, the bottom is not conically shaped and the auger screw conveyor 4 extends the width of the retort. Furthermore, in order to break up clusters of material, there is arranged two cooperating toothed bars 5 which also run the width of the retort. Both the auger screw conveyor 4 and the bars 5 are powered by a conventional motor and gearing arrangement.

In a further refinement, there is also provided means for automatically stopping the feed auger screw conveyor 21 whenever the material in the retort silo 40 reaches a predetermined level. These means generally comprise an on/off switching mechanism for supplying or shutting off power to a motor which runs feed auger screw conveyor 21 by means of power lines 24. The switching mechanism generally is a hermetically sealed plunger unit 22 maintained projecting into the retort silo 40 under a pressure, typically 5–10 lbs., by a spring assembly 23 so that as pressure from the shale presses on the plunger unit 22 to force it upwardly, power supplied through lines 24 to operate the motor of auger screw conveyor 21 is interrupted. A similar plunger unit can be provided in association with bin 15 to control the endless belt type elevator which provides communication generally from the hopper to a discharge end indicated at 16.

Figure 3:
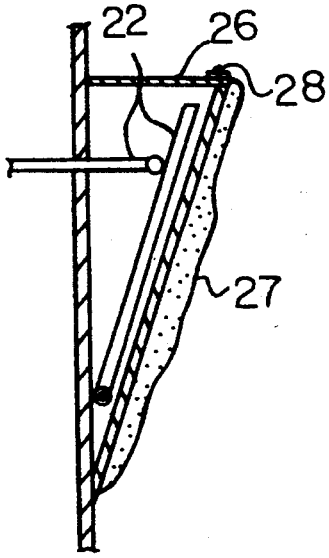
FIG. 3 is an enlarged partial side view in section of the control mechanism, illustrated in FIG. 1, for maintaining a predetermined level of material in the retort silo.
Figure 4:
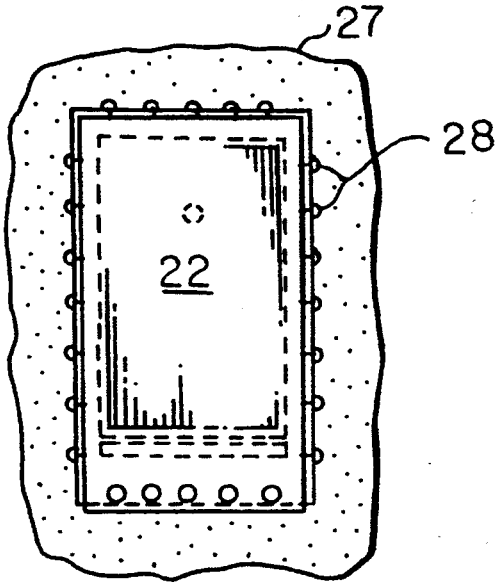
FIG. 4 is a front view of the mechanism of FIG. 3 viewed in the direction of line III—III of FIG. 1.

As shown in FIG. 3, the plunger unit 22 assembly is protected by a stainless steel shield on the top, back and at each side, and the front is covered, as shown in FIGS. 3 and 4, by a loose covering 27, typically asbestos-type cloth like that used by firemen, which fits sufficiently loose to enable the material to move with the plunger unit 22 inwardly once a predetermined level of shale in the retort 40 is reached. The loose material 27 is typically riveted 28 or screwed onto the stainless steel protective shield 26.

Thus, as the shale reaches the level of the plunger unit 22, the unit is pushed inwardly shutting off the feed through auger screw conveyor 21. This operation provides other advantages in that the delay provides sufficient time for incoming shale to be preheated, e.g., to a temperature of 200° to 300° F., and thereby aids preventing escaping retorted gases from condensing on otherwise cold incoming shale.

In this system, like the system of U.S. Pat. No. 4,325,787, the addition of acetic acid in the preheat area opens up the oil matrix and commences retorting at lower temperatures than in conventional retorts. Furthermore, the use of acetic acid at the bottom in zone 1 also serves to enhance combustion by freeing the tailings remaining in the retorted shale, and aids in the actual retorting in the side as it is carried upwardly through the material therein. Furthermore, the acetic acid at the bottom is also believed to displace nitrogen from the kerogen and provides free hydrogen to the retort which is used to form more hydrocarbonaceous products. The nitrogen also reacts with remaining acetic acid to form aromatic amines, anilines and xylidines. In the preferred mode as set forth in the example below, 76 pounds of these materials are produced per ton of shale rock versus 22 pounds produced by conventional retorting means. The type of shale employed is in this case, and in the example, is Colorado shale.

In order to prevent hang-up of the flowing shale 14, the walls of the silo converge only on two sides in the spent shale combustion zone 1. This is apparent from comparing zone 1 as it appears in FIG. 1 with the zone as it appears in FIG. 2. In the cross-section of FIG. 1 walls do not converge whereas in FIG. 2 they do converge.

The steam and acetic acid added in preheat area 21 increase heat conductivity as well as opening the oil matrix by softening the kerogenous proteins dried in the shale. The retort temperature is thus essentially 100 degrees F. less than that of conventional retorts. Moreover, the high pressure steam combines with carbon monoxide in a shift reaction producing much needed hydrogen in the retort.

The apparatus and method of the instant invention is able to handle a large quantity of fines in commercial retorting in a fluid bed because the agitation of steam and acetic acid prevents the information of "clusters" and also keeps the shale stock moving down evenly. Preferably, the water and acetic acid are applied in spurts to the hot shale rather than in a continuous flow.

In any retort, the addition of hydrogen results in more oil of better quality. The inherent hydrogen in the Kerogen is tied up and some is burned off in conventional retorts which require high heat before releasing the oil. When one uses acetic acid, one is able to retort at lower temperatures and also cleave nitrogen-containing molecules and make hydrogen available to the retort.

Also of importance here is the available carbon, since carbon comprises the largest percentage in the final product. In conventional methods, the carbon comes out in the heavy oil produced at high temperatures, whereas we obtain available carbon from an inorganic source as the acetic acid reacts with the calciums and calcites to produce $CO_2$.

When combustion takes place, there is CO produced which mixes with steam to form a "shift reaction" starting at 900° F. to produce additional H and $CO_2$.

Hydrochloric acid and propionic acids were tested to find there is no advantage in the use of such acids. However, acetic acid solutions were found to soften or open up the shale matrix to release oil of better quality at lower temperatures than these acids. Because shale differs from one area to the next, simple boiling flask testing should be done first, remembering that the fine mist produced when acetic acid is used requires extreme care when collecting the product and when once collected, extreme care must be used not to heat the finished product which contains more volatile chemicals than the control. Such care results in giving an oil having a carbon to hydrogen ratio of about 7.0. The best test design here is to periodically hit the hot shale with spurts of acetic acid.

By utilizing the principles of the instant invention, Colorado shale (35 g.p.t., Fischer assay) produces amines, anilines and xylidines, cement and 50 gallons of high-quality crude oil. The total liquid product is in the range of between approximately 120% and 180% of Fischer assay. The amines produced can be used to make artificial sweeteners, the anilines can be used for dyes or other chemical products, while xylidines can be used for cattle feed.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the following examples, all temperatures are set forth in degrees Celsius and unless otherwise indicated, all parts and percentages are by weight.

Conventional steps and products of the retort process are well known and need not be repeated here. The entire disclosure of all applications, patents and publications cited above and below are hereby incorporated by reference.

EXAMPLES

Example I

The significance of utilizing acetic acid in the process is made manifest by the following experiments. An apparatus was constructed to simulate as nearly as possible the conditions found in a continuous process according to the present invention. Colorado shale was cut to pass through a quarter inch screen resulting in samples having approximately 1% dust fines and 99% granular rock. Acetic acid was mixed with distilled water to form a 5% acetic acid solution. The cut shale was allowed to soak in the acetic acid solution for five minutes, removed, and then placed in the center of a vertical tubular retort of approximately seven inches in diameter. An electrical coil provided a source of controllable heat near the bottom of the shale mass. The acetic acid remaining after the soaking of the shale was force injected into the top of the retort in stages as the temperature of the shale was raised in 100° F. increments to a final temperature of 1200° F., thus simulating combustion. Argon gas was forced into the top of the retort to purge the retort of gases as they formed, and the purged gases were drawn through the bottom of the retort and distilled.

Two shale oil samples were each obtained from retorting 3 kg of oil shale with and without acetic acid present, all other conditions being identical. The products were analyzed by Hauser Laboratories in Test Report No. 81-246. The classical retort oil sample was in two phases. The top phase was a black, oily material and the lower phase, a yellow water layer. The acetic acid retort oil sample was a black material with no visible separation of layers and appeared to be a heavy emulsion. In this test, both samples were examined for total organic material after acid extraction and air drying. In comparison, the total organics in the acid retort shale oil was 81.8% more than the total organics found in the classical retort shale oil sample. The detailed results are as follows:

| Sample Without Acetic Acid | |
|---|---|
| Organics in Oil Fraction | 12.8%/kg oil shale |
| Organics in Aqueous Fraction | 0.3%/kg oil shale |
| Total Organics | 13.1%/kg oil shale |

| Sample With Acetic Acid | |
|---|---|
| Organics in Oil Fraction | 22.2%/kg oil shale |
| Organics in Aqueous Fraction | 2.0%/kg oil shale |
| Total Organics | 24.2%/kg oil shale |

Samples of the oils recovered form the acid extraction were analyzed by gas chromatography. 2 μl injections of the shale oil from the acid retort and the classical retort were made into an OV 101 packed column.

A temperature program of 60°-350° C. with a rate of 10 degree/min was used for the simulated distillation analysis. The carrier gas was nitrogen with a flow rate of 45 ml/min. A flame ionization detector (FID) was used to determine the oil sample components. Hydrocarbon standards from $C_6$ to $C_{40}$ were used for calibration. The results suggest that the $C_{20}$ to $C_{40}$ components found in the acid retort oil increased by 52.1% over the amount found in the classical retort oil sample.

Tared samples of the acid retort oil and classical retort oil were related to pH 9 with concentrated ammonium hydroxide ($NH_4OH$). Two phases appeared. The aqueous layers were removed from the oil layers. The oil layers were saved for further analysis. The aqueous layers neutralized with 6N hydrochloric acid (HCl) and extracted with 3×50 ml of chloroform ($CHCl_3$). The chloroform extracts were combined, dried, and evaporated. The extracted material was examined by infrared spectroscopy (IR) and gas chromatography (GC).

The spectra indicates that both samples contain amines and some carbonyl compounds. The acid retort oil sample contains a higher proportion of aromatic compounds as indicated by the increased absorption of 1050 $cm^{-1}$. There are similarities in the types of compounds found in both extraction products. A more detailed examination of the extracts was made by gas chromatography.

Analysis of the chloroform extracts from the shale oils were made on a Tenax packed GC column. This column packing is suitable for the separation of high boiling point polar compounds, such as phenols, alcohols, amines and acid. The temperature rise of 10° C./min. The nitrogen carrier flow rate was 25 ml/min.

Analysis of the chloroform extracts from the shale oil showed the following classes of compounds, and approximate yields:

TABLE 1

Gas Chromatographic Analysis of Chloroform Extracts

| Compounds | Acid Retort Oil lb/ton oil shale | Classical Retort Oil lb/ton oil shale |
|---|---|---|
| Alcohols $C_4$, $C_5$, $C_6$ | 6 | 6 |
| Phenols | 4 | 12 |
| Cresols | 4 | 2 |
| Aromatic Amines, (aniline, xylidines, etc.) | 76 | 22 |

The potential market value of these compounds according to 1981 demand and dollars is listed in Table 2. The price/lb. for technical grade material and the price/ton of oil shale is also listed in Table 2.

TABLE 2

Market Value of Compounds in Chloroform Extract

| Compound | $/lb | Acid Retort lb/ton oil shale | Acid Retort Commercial Value, $ |
|---|---|---|---|
| Alcohols $C_4$, $C_5$, $C_6$ | 0.25 | 6 | 1.50 |
| Phenols | 0.46 | 4 | 1.84 |
| Cresols | 0.76 | 4 | 3.00 |
| Aromatic Amines | 0.57 | 76 | 43.32 |
| Total | | 90 | 49.66 |
| | Classical Report | | |
| Alcohols $C_4$, $C_5$, $C_6$ | 0.25 | 6 | 1.50 |
| Phenols | 0.46 | 12 | 5,52 |
| Cresols | 0.75 | 2 | 1.50 |
| Aromatic Amines | 0.57 | 22 | 12.54 |
| Total | | 42 | 21.06 |

Tared samples from the acid retort oil and the classical retort oil were acidified with 6N hydrochloric acid. The aqueous layers were removed and analyzed by gas chromatography using the Tenax column previously described. A temperature program from 110° to 300° C. at a rate of 10 degrees/min was used. Even chain fatty acids, from $C_6$ to $C_{14}$, were used as standards in this analysis. 1 μl injection was used for each aqueous sample. It was found that the aqueous layers from both the acid retort oil and the classical retort oil contained fatty acids. Table 3 shows the types of fatty acids and the quantity of fatty acid found in each of the shale oils.

TABLE 3

| Fatty Acid | Acetic Acid lb/ton shale oil | Classical Retort Oil lb/ton shale oil |
|---|---|---|
| Hexanoic Acid, $C_6$ | 2.4 | 3.2 |
| Octanoic Acid, $C_8$ | 2.7 | 1.6 |
| Decanoic Acid, $C_{10}$ | 0.7 | |
| Flodecanoic Acid, $C_{12}$ | 3.2 | 4.1 |
| Tetradecanoic Acid, $C_{14}$ | 1.6 | 1.3 |
| Totals | 10.6 | 10.2 |

There are no significant changes in the quantities of fatty acids produced by the two processes. The price for sale of the technical grade fatty acids were $0.55/lb in 1981. This would indicate a price of $5.83/ton of oil shale.

Additional Chemical Properties of Shale Oil Samples

The carbon, hydrogen, oxygen, nitrogen and sulfur composition of the shale oil from the acid retort oil was:

| | |
|---|---|
| Carbon | 79.87% |
| Hydrogen | 11.43% |
| Oxygen | 4.28% |
| Nitrogen | 1.08% |
| Sulfur | 0.63% |

This indicates a C/H ratio of 7.0 and shows the shale oil is satisfactory for refining. The shale oil contains a low percentage of nitrogen and sulfur.

The differences in the shale oil recovered from the acid retort and the classical retort shale oil can be classified in two parts. First, the characterization of the oil and second, the characteristics of the byproducts obtained.

It is apparent from the studies on these oils that the acetic acid treatment produced more oil which contained a higher content of $C_6$–$C_{19}$ hydrocarbons and a 50% increase in the quantity of $C_{20}$–$C_{40}$ hydrocarbons. There is a substantial increase in the total amount of oil produced from the acetic acid retorting of this oil shale. Elemental analysis of the shale oil is obtained through the acetic acid process shows a C/H ratio of 7.0.

The evaluation of the byproducts from the shale oil provides several interesting and significant results. The acetic acid treatment does not increase the quantities of fatty acids produced over the classical retorted oil. The shale oil obtained from acetic acid treatment does appear to increase the total amount of aromatic amines as compared to the classical retort oil. The increased production of aniline, xylidines, and substituted anilines is 345%, as compared to the classical retorted shale oil. The production of other common byproducts such as phenols, cresols, and alcohols are not significantly changed in the acetic acid retorting process.

There is an apparent increase in the total organics produced when acetic acid is added during retorting. A 30% increase in the $C_6$–$C_{19}$ hydrocarbons, and a 50% increase of the $C_{20}$–$C_{40}$ hydrocarbons was noted. Similarly a 345% increased production of aromatic amines was observed.

Example II

A typical retort according to the invention is approximately 40 ft high above the retorted shale combustion zone with a 12 ft high retorted shale combustion zone. The inner tank is 12 ft in diameter and of suitable structural steel clad on the inside. The production from such a retort system is typically 686.4 barrels per silo/day of 28.6 barrels per hour with a continuous feed of crushed shale.

More specifically, at the rate of 20 tons of shale rock/hr.; there is produced 60.2 gallons of organics per ton, or a total of 1,204 gallons of condensed organics per hour. There will also be available 757.4 lbs. of carbon per hour in the retorted shale to be burned to provide heat for silo at the bottom. This amount of carbon requires 102,050 $ft^3$ (standard) of cold air to provide $2.69 \times 10^6$ kilo calories per hour. This amount of heat is sufficient to raise the temperature of the retort to the 900° to 1000° F. required. Such temperatures retort all the oil, leaving only carbon, calcium and calcites.

From the oil shale retort of this invention, three products are obtained:

(1) There is 1,000 lbs. of cement from each ton of shale rock. This cement is suitable for highways, sidewalks, cement floors and cement blocks in home construction.

(2) Also obtained are 76 pounds of amines, anilines, and xylidines. These are separated from the crude oil by titration using a base (Ammonium Hydroxide) and an acid, such as hydrochloric acid. The amines can be used to produce a sweetener. Anilines can be used for dyes or can be easily converted into other chemicals. Xylidines can be used for cattle feed.

(3) Also obtained is a high quality crude, equal to light Saudi crude.

The process retorts at 185% of the Fischer assay due to the fact that acetic acid is a catalyst in a shift reaction which combines carbon monoxide with steam and acetic acid to produce large quantities of carbon and hydrogen which are the main components of crude oil. Such a catalyst negates the need of 300 p.s.i. pressure normally needed for a shift reaction to occur. Hence, the process retorts at a continuous pace and produces great quantities of free carbon and hydrogen.

The above Examples can be repeated with the exception that chopped-up pine tops are substituted for the oil shale as disclosed in my prior U.S. Pat. No. 4,396,487.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for the continuous processing of a solid particulate, oil-bearing or oil-yielding raw material to form a non-volatile residue and a distillate comprising a hydrocarbonaceous oil, the process comprising feeding the raw material into the upper end of a vertical retort chamber and successively passing the material through:

a retort zone wherein the material is heated by steam, acetic acid and combustion gases passing upwardly from a combustion zone to cause breakdown of kerogen and volatilization of oil products, a control zone wherein water and acetic acid are injected to cause a chemical reaction with organic materials contained in the solid materials and to limit the combustion to a combustion zone, a combustion zone wherein retorted solids are combusted with forced air, and a spent material removal zone wherein spent materials are removed from the bottom of the retort chamber;

and wherein said process further comprises drawing off volatilized gases.

2. A process as in claim 1, wherein said raw material is preheated in a preheating zone, with the addition of acetic acid and steam thereto, prior to feeding said material to said retorting zone.

3. A process as in claim 1, wherein said water and acetic acid in said control zone are applied in spurts.

4. A process as in claim 1, wherein said raw material is a lignocellulosic material and wherein said distillate includes activated lignin.

5. A continuously operable retort-type processing system for recovery of petroleum products from comminuted oil shale comprising:

retort means having a bottom and a top with a retorting zone disposed therebetween;

feed means, including burners located at said feed means for preheating the comminuted oil shale as the material passes through said feed means and before the material enters the retort means, the preheating means including acetic acid and steam feed means communicating with the feed means for injecting acetic acid and steam into the comminuted oil shale being conveyed through said feed means;

a retorted shale combustion zone located in the retort means near the bottom thereof and having combustion means therein for combusting retorted shale entering said combustion zone from said retort means under conditions to maintain the combustion zone temperatures at approximately 1200° F. to provide the heating requirements of said retort means;

thermocouples located above the combustion zone for automatic activation of the acetic acid and water injection means;

acetic acid and water injection means positioned just upstream of the combustion zones for injecting water and acetic acid into said retort means above said combustion zone to prevent combustion from spreading therefrom into material being retorted in said retort means and to enhance breakup and fluidization of the shale being retorted;

gaseous products discharge means disposed adjacent the top of the retort means for discharging gaseous products from the retort means, and condenser means associated therewith for condensing volatilized liquids from the discharged gaseous products;

means connected to said condenser means and to the burners in the preheating means for conveying gaseous products from the condenser means to the burners whereby said gaseous products are burned as they exit from said burners to provide heat to said feed means; and solids discharge means disposed beneath the bottom of the retort means for discharging combusted shale from the retort means.

6. A system according to claim 5, wherein said retort shale combustion zone comprises heat supply means for supplying the heat necessary to initiate combustion of retorted shale, and pressurized air supply means for supplying the oxygen requirements to sustain combustion of said retorted shale.

7. A system according to claim 6, wherein said feed means comprises a feed auger screw conveyor wherein the material is preheated while being conveyed into the retort means.

8. A system according to claim 5, further comprising grinding means and a discharge auger screw conveyor operatively associated and running the width of the retort means at the bottom discharge end of the retorted shale combustion zone for breaking up clusters of burnt spent shale, and for discharging cement material from said combustion zone.

9. A system according to claim 8, wherein said feed means comprises a spring loaded plunger activated switch with a protective cover thereover arranged in a manner whereby power to a motor associated with said feed auger is shut off when the pressure from the material in the retort means exceeds a predetermined value.

10. A system according to claim 5, further comprising feed control means including a level detecting switch with a cover thereover for detecting the level of material in the retort means, and for shutting off said feed means when the material level in said retort means exceeds a predetermined value.

11. A system according to claim 5, further comprising insulation means surrounding said retort means to prevent heat loss therefrom, wherein said insulation means surrounding said retort means include an air passageway adapted for conveying air, which has been passed over the hot discharge, to the area of the feed means, thereby transferring heat from the hot discharge to the incoming oil shale.

12. A system according to claim 5, wherein the retorted shale combustion zone has a pair of converging straight sides joined by a pair of parallel ends, wherein the solids discharge means includes an auger disposed parallel to the straight sides of the retorted shale combustion zone and normal to the vertical axis of the retort, the combustion zone including rotating toothed bars at the lower end thereof juxtaposed with the auger.

13. In a process for the production of a hydrocarbonaceous oil by heating a hydrocarbonaceous or lignocellulosic solid material to form a non-volatile residue and a distillate comprising a hydrocarbonaceous oil, the improvement which comprises directly combusting the solid material in a combustion zone in a chamber, injecting water and acetic acid immediately above the combustion zone to form hot combustion gases, steam and acetic acid at a temperature of at least 450° C. which gases pass upwardly through the starting material and initiate distillation of the starting material.

* * * * *